United States Patent [19]

Ferracane

[11] 4,183,568

[45] Jan. 15, 1980

[54] LOCK GUARD

[76] Inventor: Hugo F. Ferracane, 45 Vernon St., Patchoque, N.Y. 11772

[21] Appl. No.: 905,998

[22] Filed: May 15, 1978

[51] Int. Cl.[2] ..... E05C 13/00

[52] U.S. Cl. ..... 292/341.18; 292/346

[58] Field of Search ..... 292/341.18, 341.19, 292/340, 346

[56] References Cited

U.S. PATENT DOCUMENTS

| | | | |
|---|---|---|---|
| 34,243 | 3/1901 | Taylor | 292/346 |
| 913,410 | 2/1909 | Marbach | 292/341.18 |
| 1,238,924 | 9/1917 | Kennedy | 292/341.19 |
| 1,919,739 | 7/1933 | Minzenmayer | 292/346 |
| 2,993,719 | 7/1961 | Manchester | 292/341.18 |
| 3,257,139 | 6/1966 | Russell et al. | 292/341.18 |
| 3,316,007 | 4/1967 | Russell | 292/341.18 X |
| 4,017,106 | 4/1977 | Salazor | 292/340 |

*Primary Examiner*—Richard E. Moore
*Attorney, Agent, or Firm*—Edith T. Grill

[57] ABSTRACT

A security lock guard adapted to engage a sliding bolt and to be mounted overlying the recess on the door jamb consisting of a flat plate having an opening corresponding with said recess to receive said bolt, said opening being provided with a plurality of removable tabs so as to accommodate the width of differently sized bolts; and a flange extending outwardly and perpendicularly from the outer edge of said flat plate and in contact with the inner surface of the door stop disposed on the door jamb. This perpendicular flange acts as a barrier against the insertion of a thin blade or other object between the door edge and the jamb even if the door stop is lifted or removed from the door jamb.

10 Claims, 7 Drawing Figures

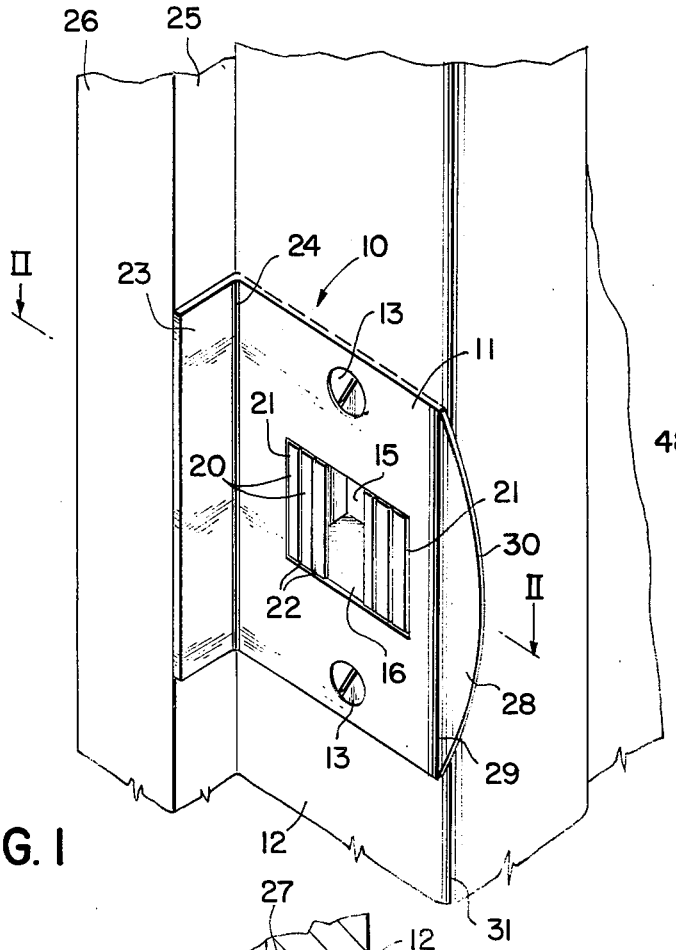
FIG. 1
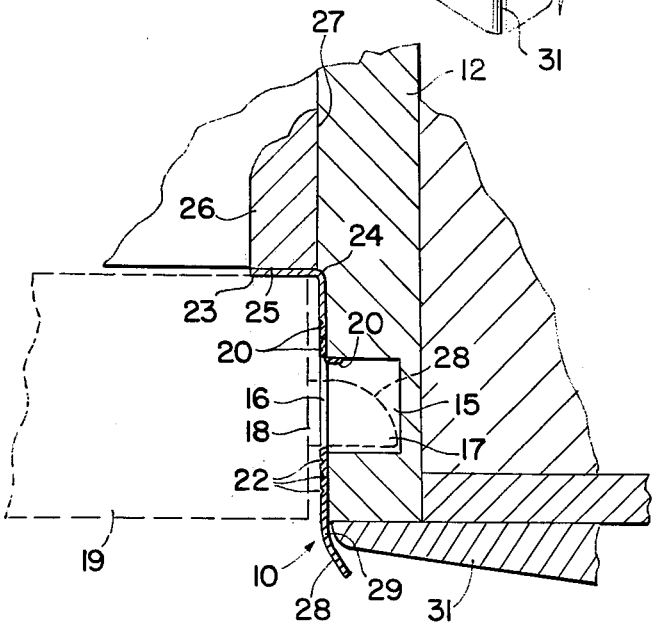
FIG. 2
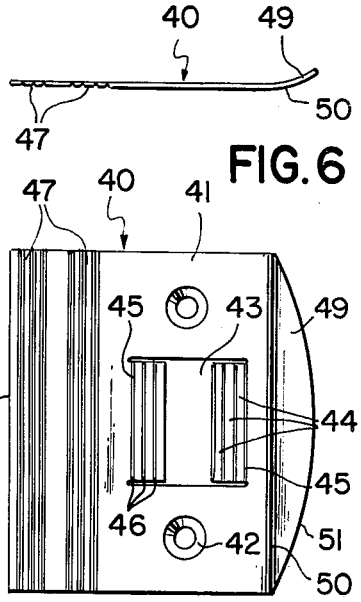
FIG. 6
FIG. 5
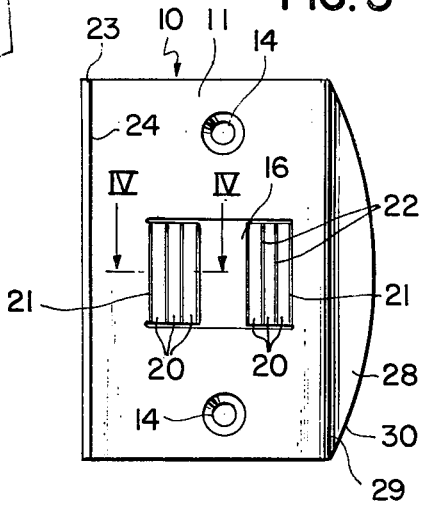
FIG. 3
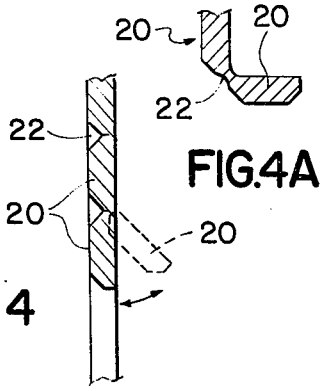
FIG. 4A
FIG. 4

LOCK GUARD

This invention relates to a novel security lock guard to render door locks associated therewith tamper-proof.

Unauthorized and forcible entry is a problem of long standing. It is generally well known that by inserting a thin card, knife blade or the like between the door edge and the door jamb, the sliding bolt can be retracted, thus unlocking the door without a key. The addition of a door stop molding on the door jamb to prevent this simple means of entry has not been effective in preventing such unauthorized entry, because said door stop can easily be loosened and/or removed, thereby facilitating the use of a thin knife blade as a means of retracting the bolt and opening the door.

DESCRIPTION OF THE PRIOR ART

Accordingly, the prior art is replete with security devices designed to solve this problem, some of which are described below.

U.S. Pat. No. 2,484,024 to Garberding discloses an elongated latch bolt guard mounted on the door jamb adjacent to the striker or keeper plate by means of a series of prongs in addition to two mounting screws, said bolt guard being centered with respect to the latch bolt aperture. This device is described as not requiring any alteration of the existing structures because of its thickness which is only 1/32 of an inch, the customary operating clearance between the edge of the door and the door jamb as well as between the face of the door and the door stop. Despite the thinness of this material, adequate rigidity is allegedly attributed to this particular construction both during installation and to resist tampering. Nevertheless, it is conceivable that this thin metal strip can be deformed and pried loose by a knife blade or similar object inserted thereunder. Furthermore, the numerous prongs are capable of damaging the wood frame at the door jamb.

U.S. Pat. No. 2,454,904 to Wylie discloses a door lock guard mounted on the edge of the door, surrounding the bolt which is a flat plate with a recess for the bolt and provided with a right angled lip which contacts the outer face of the door, said guard projecting beyond the outer face of the door and designed to enter a slot formed on the inner surface of the door stop. This device does not prevent the insertion of a thin blade between the door stop and the door jamb to deflect the sliding bolt. Furthermore, the standard woodwork, more specifically the door stop, must be modified in order to receive this door lock guard.

U.S. Pat. No. 3,377,094 to Thompson discloses a reversible lock guard for out-swinging doors to be mounted on the door edge and overlying the adjacent door jamb, which comprises a flat mounting plate with a central recessed portion to permit free movement of the bolt, said plate being provided with perpendicular T-shaped wings which cover the crack between the door and jamb. This guard also cannot prevent the sliding of a knife blade between the door stop and the door jamb to retract the sliding bolt.

U.S. Pat. No. 3,606,429 to Palmer discloses a safety lock plate mounted on the jamb at the recess thereof which is provided with an opening for the bolt to pass through and an inwardly directed flange at an angle to said plate of 70°–80°, situated at the edge of said recess and designed to contact the curved edge of the bolt contained within said recess. This is alleged to prevent the bolt from being retracted by a thin stiff plate, and to deflect any inserted object away from the bolt. This assumes that the bolt is held rigidly by the inwardly extending flange, mere contact therebetween being ineffective as a bolt holding means. Even a slight clearance between the inward extending flange and the edge of the bolt would permit an inserted object to retract said bolt, and thereby open the lock.

U.S. Pat. No. 3,967,845 to Governale discloses a metal reinforcing plate mounted beneath the usual striker plate, in a routed recess of the wooden door jamb which is concealed from view, in order to impart to the door structure extra strength against forceable entry. This device requires alteration of the existing structure for installation and does not eliminate the possibility of the insertion of a blade between the door stop and the door jamb to retract the bolt, thereby unlocking the door.

U.S. Pat. No. 3,442,543 to Weyman discloses a striker plate for a door lock having a sidewardly extending lip to deflect a flat strip of celluloid away from the curved side of the bolt, thereby preventing the retraction of the sliding bolt. However, the door must be modified to clear this bolt shield when opening and closing the door.

U.S. Design Pat. No. 34,243 by Taylor shows a design for a bolt guard which consists of a flat mounting plate terminating in a perpendicular T-shape with one wing of said T being doubled, a pair of openings in said mounting plate, each opening being provided with a pair of parallel flanges extending perpendicularly from opposite edges of said opening. In order to mount this bolt guard on either the door or the door jamb, extensive modification of the wood structure would be necessary to accommodate this device. This may account for its absence in the present market although it was patented as early as Mar. 1901.

Accordingly, there are many devices in the prior art designed to make door locks burglar proof. Some are mountable on the door surrounding the latch bolt. Others are to be affixed to the opposing door jamb either under, adjacent or superimposed on the striker plate to reinforce said plate, or are used as substitute striker plates. Each of aforedefined devices are partial solutions to this burglary problem and afford some protection against unauthorized and/or forceable entry. In addition, some require modification of existing structures for installation. Furthermore, all of the prior art striker plates are provided with a single-sized opening to accommodate latch bolts of certain specific sizes only. This requires the manufacture of a series of striker plates, each to accommodate a specifically sized sliding bolt. Thus, it is apparent that none of the prior art striker plates are capable of being used with sliding bolts of all sizes; and none of the prior art devices create an effective barrier to prevent the latch bolt from being retracted by an insert between the door stop and the jamb without some modification of the existing wood structure or the accompanying hardware.

Accordingly, it is a principal object of the present invention to provide a simple and economical security lock guard which is easy to install and to be used as a substitute striker plate.

Another object of present invention is to provide a tamper proof lock guard capable of effectively shielding the sliding latch bolt from being retracted even when the door stop molding is removed from the door frame.

Still another object of present invention is to provide a security lock guard capable of being installed on existing door jambs without modification of either the door or the door jamb structures.

A further object of this invention is to provide a security lock guard usable with existing hardware.

Another object of this invention is to provide a lock guard with a multi-sized opening to accommodate latch bolts of different sizes.

Still further objects and advantages of the invention will become apparent from the following detailed description.

DESCRIPTION OF THE INVENTION

Accordingly, the present invention relates to a customized novel security lock guard adapted to be used with existing hardware and without modification of the door and/or the door jamb and to render a sliding latch bolt lock tamper-proof by providing an effective barrier against the insertion of a tin card, blade or similar object between the door stop and door jamb, which is in the form of a flat plate provided with a multi-sized opening for receiving a sliding latch bolt, said opening having a series of removable tabs integral with each of the vertical edges of said opening and situated within said opening; an integral preformed flange extending outwardly and perpendicularly from the outer edge of said plate parallel to and in contact with the door stop; and a pair of spaced apart apertures to receive mounting screws. The guard plate may additionally be provided with an inwardly curved flange terminating in a rounded outer edge, integral with the inner edge of said flat plate and directly opposite said perpendicular flange.

The removable tabs are joined to each other and to the edge of the opening by a connecting means such as partial serrations, scoring or indentations of about one half the thickness of the metal plate so that it is necessary to flex at said scored or indented junction at least several times in order to remove each tab. The attachment or connecting means of said tabs should not be so fragile that a single flexing is sufficient to remove the tab, but should be firm enough to permit the tabs to be retained in a bent position after a single flexing. The thickness of the metal plate is preferably about 0.45 to 0.55 inches and the indentations separating each tab is about one half the thickness of said metal plate, i.e. about 0.225 to 0.275 inches at each junction. Each tab is preferably about ⅛ inch wide. The width of the opening in the guard plate designed to receive the latch bolt can be adjusted to accommodate the particular width of said latch bolt by removing one or more of said tabs to enlarge said opening, thereby customizing a single plate to accommodate differently sized latch bolts. Instead of removing the tabs, they may also be bent inwardly into the recess of the door jamb and be retained in said bent position therein. In addition to enlarging the opening, said retained bent tabs provide anchoring means or lips into the door jamb, thereby affording a stronger attachment of the guard plate to the door jamb. The series of removable tabs depending from each of the opposing vertical edges of the latch bolt opening constitutes preferably about three adjoining tabs, although a series of two to four are also contemplated. The latch bolt opening in the guard plate or security lock strike plate is preferably centrally lcated and square in shape. However, a round opening may also be utilized and the opening may also be located off-center.

The outwardly extending perpendicular flange which is parallel to the inner surface of the door stop and preferably in contact with said door stop, functions as an effective barrier against any object inserted between the door edge and the door jamb, from reaching the recess containing the latch bolt. This perpendicular flnge functions as a barrier against any inserted object even after the door stop molding is completely removed from the door jamb. The perpendicular flange is preferably sized to coincide with the depth of the door stop so that it is not visible from the outside of the door, when the door is in a closed position. However, larger flanges can also be utilized without impeding the movement of the door when either closing or opening said door.

The inwardly curved flange which terminates in a rounded outer edge, extending from the inner edge of the flat plate is designed to hug the door jamb, and to eliminate protruding sharp corners adjacent to the door molding at the doorway opening.

A modified lock guard in accordance with present invention, which further customizes said lock guard by providing for the individual formation of the outwardly extending perpendicular flange at the site of use, i.e., at the door lock, in lieu of the preformed perpendicular flange, comprises a flat plate with a series of parallel linear flexing means, such as linear scoring or linear indentations, heretofore known as flex lines, disposed on either the front or rear face of said flat plate and parallel to the outer edge of said plate, which permits the bending at each of said flex lines into a perpendicular flange of the desired size to coincide with the door stop. The plate is bendable into a forwardly extending perpendicular flange at flex lines disposed on the front or rear face of said plate, since said flex lines are bendable in either direction. This permits the main body of the plate to be independently fitted to the width of each door jamb and the perpendicular flange to be sized to fit the door stop. Any excess plate can be flexed several times and completely removed from said guard plate.

This modified lock guard is also provided with a pair of spaced apart apertures for receiving mounting screws; a multi-sized opening provided with inwardly extending removable tabs integral with the vertical edges of said opening, in order to adjust the size of the opening to accommodate the sliding latch bolt; and preferably an inwardly curved flange extending from, and integral with the inner edge of said flat plate and terminating in a rounded edge.

More specifically, present invention relates to a tamperproof lock guard adapted to be used with a sliding latch bolt and mountable on the door jamb overlying the recess for receiving said latch bolt and adjacent to the door stop, which comprises a unitary rigid flat plate provided with a multi-sized opening for receiving said latch bolt, defined by a pair of vertical edges and a pair of horizontal edges, said opening being provided with a series of inwardly extending removable tabs integral with each of the vertical edges of said opening for adjusting the size of the opening to accommodate said latch bolt; an outwardly extending preformed perpendicular flange integral with the outer edge of said plate to be parallel to said door stop; and a pair of spaced apart mounting apertures to receive mounting screws. The flat plate is additionally provided with an inwardly curved flange integral with the inner edge of said plate and terminating in a rounded edge. The perpendicular flange may either be preformed or self-formable by bending said flat plate into a perpendicular flange at one of a plurality of parallel flex lines disposed on the face of said flat plate, parallel to the outer edge of said plate.

Thus, it is apparent that present lock guard provides protection to a latch bolt lock from being forcibly retracted by the use of a thin insert placed between the door edge and door jamb even with the door stop removed, without resorting to any modification of the woodwork of the jamb or the door and with existing latch bolt locks. The present lock guard is simply mounted on the door jamb overlying the recess in the door jamb for receiving the latch bolt by means of two mounting screws. The opening in the lock guard coincides with the recess in the jamb and can be adjusted to the size of the latch bolt by removing or bending inwardly into the jamb one or more removable tabs. The perpendicular flange lies parallel to the door stop, and is preferably in contact therewith, so that said flange functions as a barrier to an insert between the door edge and jamb, irregardless of the presence or absence of a door stop.

In the accompanying drawings which form a part of this application,

FIG. 1 is a perspective view of the lock guard in accordance with the present invention, mounted on a door jamb;

FIG. 2 is a cross-sectional view taken on line II—II of FIG. 1 in conjunction with a latch bolt mounted on a door edge;

FIG. 3 is a front elevational view of the lock guard in accordance with the present invention;

FIG. 4 is a sectional view on line IV—IV of FIG. 3, showing the removal of a tab;

FIG. 4A is an enlarged view of the removable tab in a bent position;

FIG. 5 is a front elevational view of a modified form of this invention; and FIG. 6 is a top view of said modified form of this invention.

Referring to the drawings in detail, present novel lock guard 10 comprises a rigid flat plate 11, mounted on door jamb 12 by means of screws 13 secured through a pair of spaced apart apertures 14 situated on the face of plate 11, and overlying recess 15 in jamb 12. Flat plate 11 is provided with a multi-sized opening 16, which coincides with recess 15, for receiving a sliding latch bolt 17 mounted on, and protruding from inner edge 18 of door 19. Multi-sized opening 16 is provided with a series of elongated removable tabs 20 integral with each of the vertical edges 21 of opening 16 and situated within opening 16. One or more tabs 20 may be flexed repeatedly until removed as shown in FIG. 4 or bent as shown in FIG. 4A in the direction of recess 15 in door jamb 12 and retained as shown in FIG. 2. Each tab 20 is connected to its adjacent tab 20 by bendable connecting means 22 such as scoring or indentations or partial serrations or the like to permit flexing at said connecting means 22. Edges 21 of opening 16 integral with tabs 20 are similarly connected by bendable connecting means such as scoring or indentation or partial serrations or the like to permit flexing at said connectng means 22.

Flat plate 11 is additionally provided with an outwardly extending flange 23 perpendicular to plate 11 and integral with outer edge 24 of plate 11, said preformed perpendicular flange 23 being parallel to and preferably in contact with inner surface 25 of door stop 26 disposed on door jamb 12. The insertion of a flat object between door jamb 12 and inner edge 18 of door 19 and under door stop 26 at junction 27 in an attempt to unlock the door by pushing said inserted object across the inclined wall 28 of sliding bolt 17 to retract bolt 17 is barred from entering recess 15, by perpendicular flange 23.

Flat plate 11 may be additionally provided with an inwardly curved flange 28, i.e., in the direction of the jamb, integral with the inner edge 29 of flat plate 11 and directly opposite perpendicular flange 23. Flange 28 has a rounded outer edge 30 to eliminate protruding sharp corners adjacent to the door molding 31.

A modified lock guard 40 in accordance with present invention as shown in FIGS. 5 and 6, consists of a rigid flat plate 41, preferably rectangular, provided with a pair of spaced apart apertures 42 for receiving mounting screws 13; a multi-sized opening 43 situated off-center and provided with a series of removable tabs 44 integral with the vertical edges 45 of opening 43 and interconnected by bendable connecting means such as scoring, partial serrations or indentations 46 of lesser thickness than, about one half the thickness of flat plate 41 to render tabs 44 removable from each other and from vertical edge 45 by repeated (at least several) flexings. Tabs 44 may also be bent and retained as anchoring means or lips as shown in FIG. 2. Tabs 44 are elongated and about ⅛ inch wide, and extend from vertical edges 45 into opening 43.

Flat plate 41 is additionally provided with multiple parallel flexing means or flex lines 47 situated on either the front or rear face of plate 41, and parallel to outer edge 48, flex lines 47 being in the form of linear scoring or linear indentations of lesser thickness than that of the metal plate, to permit bending at each of said flex lines 47 into a perpendicular flange. This feature customizes the lock guard by enabling the flat plate to be fitted to the width of the door jamb and the perpendicular flange sized to fit the door stop, whereby the lock guard is concealed from view when the door is closed. Each of flex lines 47 can be repeatedly flexed (at least several times) in order to remove the portion of plate encompassed by said flex line 47 and outer edge 48.

Flat plate 41 may be additionally provided with an inwardly curved flange 49, towards the door jamb, extending from and integral with inner edge 50 of flat plate 41, and terminating in a rounded edge 51.

Modified lock guide 40 is similarly mounted on door jamb 12 overlying recess 15 after a flex line 47 is bent outwardly to form a perpendicular flange which is parallel to and preferably in contact with door stop 26 at its inner surface 25.

It will be readily appreciated that with this lock guard mounted on a door jamb in lieu of the conventional striker plate, and as a substitute therefor, a tamperproof lock guard is obtained, whereby a flat object inserted between the door stop and the jamb is completely stopped by the outwardly extending perpendicular flange, at the position of the door stop, thereby not permitting access to the recess containing the sliding latch bolt. Furthermore, the multi-sized opening in the guard plate renders it useful with differently sized latch bolts, thereby permitting its universal applicability and allows for customizing the lock guard to fit each sliding latch bolt. The modified form of this invention which provides for the formation of the perpendicular flange by bending at any one of several flex lines provided on the face of said lock guard plate completely customizes the lock guard to fit each particular door jamb and each door stop. Other advantages of this invention are the ability of this lock guard to be completely concealed from view when the door is closed, its unobtrusiveness, its capability of being mounted on existing wood structures without any modifications whatsoever and its adaptability for use with existing hardware.

Present lock guard is rigid metal, such as steel, and can be stamped from a single sheet of metal as a unitary unit. Although steel is the preferred metal, other rigid metal alloys can also be used.

Although this invention has been described with reference to specific embodiments, it will be apparent to one skilled in the art that various modifications and equivalents may be made thereto which fall within the scope herein.

I claim:

1. A security lock guard adapted to engage differently sized latch bolts and to be mounted overlying the recess on the door jamb, which comprises a unitary rigid plate provided with an opening for receiving said latch bolt and adjustable to the width of said latch bolt by means of at least one flange extending into said opening and forming horizontal slots with the horizontal edges of said opening, said flange comprising a series of tabs separated by areas of reduced cross-section to facilitate bending; at least one series of parallel vertical grooves situated at the outer end of said plate to facilitate bending into a substantially perpendicular flange; and a pair of spaced apart mounting apertures to receive mounting screws for securing said plate to said door jamb.

2. A lock guard in accordance with claim 1, wherein two flanges directed twoards each other extend into said opening from opposite edges of said opening, forming an H-shaped slot, each of said flanges comprising a series of tabs separated by areas of reduced cross section to facilitate bending.

3. A lock guard in accordance with claim 1, wherein one or more tabs are removed by means of repeated flexing at an area of reduced cross section to enlarge said opening.

4. A lock guard in accordance with claim 1, wherein one or more tabs are bent inwardly into said recess.

5. A lock guard in accordance with claim 1, wherein the outer end of the plate is bent into a substantially perpendicularly projecting flange at one of said parallel grooves.

6. A lock guard in accordance with claim 4, wherein the end of the plate is bent into a substantially perpendicularly projecting flange at one of said parallel grooves.

7. A lock guard in accordance with claim 1, wherein the inner end of said plate is curved towards the door jamb and terminates in a rounded edge.

8. A lock guard in accordance with claim 7, wherein the outer end of the plate is bent into a substantially perpendicularly projecting flange at one of said parallel grooves.

9. A lock guard in accordance with claim 1, wherein at least one tab is removed by means of repeated flexing to enlarge said opening and at least one tab is bent inwardly into said recess.

10. A lock guard in accordance with claim 1, wherein the outer end of said plate is bent into a substantially preformed perpendicularly projecting flange.

* * * * *